US011549741B2

(12) United States Patent
Ahn

(10) Patent No.: US 11,549,741 B2
(45) Date of Patent: Jan. 10, 2023

(54) APPARATUS FOR SENSING AND REMOVING DEW ON REFRIGERATOR AND CONTROLLING METHOD THEREOF

(71) Applicant: LG ELECTRONICS INC., Seoul (KR)

(72) Inventor: Seunguk Ahn, Seoul (KR)

(73) Assignee: LG ELECTRONICS INC., Seoul (KR)

( * ) Notice: Subject to any disclaimer, the term of this patent is extended or adjusted under 35 U.S.C. 154(b) by 563 days.

(21) Appl. No.: 16/573,388

(22) Filed: Sep. 17, 2019

(65) Prior Publication Data

US 2020/0011587 A1 Jan. 9, 2020

Related U.S. Application Data

(62) Division of application No. 15/388,309, filed on Dec. 22, 2016, now Pat. No. 10,458,694.

(30) Foreign Application Priority Data

Feb. 2, 2016 (KR) ..... 10-2016-0013063

(51) Int. Cl.
*F25D 21/02* (2006.01)
*F25D 21/08* (2006.01)
(Continued)

(52) U.S. Cl.
CPC ..... *F25D 21/02* (2013.01); *F25D 21/08* (2013.01); *F25D 23/02* (2013.01); *F25D 29/005* (2013.01)

(58) Field of Classification Search
CPC ..... F25D 21/02; F25D 21/08; F25D 23/02; F25D 29/005
(Continued)

(56) References Cited

U.S. PATENT DOCUMENTS 3,188,828 A * 6/1965 Wayne ..... F25D 21/02 219/509
4,862,701 A 9/1989 Small et al.
(Continued)

FOREIGN PATENT DOCUMENTS

CN 1035716 9/1989
CN 2733282 10/2005
(Continued)

OTHER PUBLICATIONS

Korean Office Action dated Mar. 30, 2017 issued in Application No. 10-2016-0013063.
(Continued)

*Primary Examiner* — Henry T Crenshaw
(74) *Attorney, Agent, or Firm* — KED & Associates LLP

(57) ABSTRACT

Provided is an apparatus for sensing and removing dew on a refrigerator. The apparatus may include a heater disposed at a refrigerator body or inside a surface of a door, and a sensor disposed in close proximity to the heater. The sensor may be configured to sense dew formed on a prescribed surface at the refrigerator body or the door. The sensor may be disposed physically separate from the prescribed surface to sense formation of dew on the prescribed surface. The heater is controlled to generate heat that removes the sensed dew on the prescribed surface based on a signal from the sensor.

18 Claims, 9 Drawing Sheets

(51) Int. Cl.
*F25D 29/00* (2006.01)
*F25D 23/02* (2006.01)

(58) Field of Classification Search
USPC ..... 219/509
See application file for complete search history.

(56) References Cited

U.S. PATENT DOCUMENTS

| | | | | |
|---|---|---|---|---|
| 5,000,579 | A * | 3/1991 | Kumada | G01N 25/68 374/10 |
| 5,899,078 | A | 5/1999 | Mager | |
| 7,340,907 | B2 | 3/2008 | Vogh, III | |
| 8,539,783 | B1 | 9/2013 | Bunch | |
| 10,173,579 | B2 | 1/2019 | Veerasamy | |
| 2009/0045820 | A1 | 2/2009 | Shimazawa | |
| 2012/0042666 | A1 | 2/2012 | Besore | |
| 2012/0047919 | A1 | 3/2012 | Besore | |
| 2013/0081416 | A1 * | 4/2013 | Kim | F25D 21/006 62/151 |
| 2013/0312445 | A1 | 11/2013 | Isetti | |
| 2014/0260384 | A1 | 9/2014 | Millett | |

FOREIGN PATENT DOCUMENTS

| | | | |
|---|---|---|---|
| CN | 102997548 | | 3/2013 |
| JP | 8-338679 | | 12/1996 |
| JP | 2006-266809 | | 10/2006 |
| JP | 2007-147090 | | 6/2007 |
| JP | 4304772 | | 7/2009 |
| JP | 2012-098044 | | 5/2012 |
| JP | 5123684 | | 1/2013 |
| JP | 2013-253739 | | 12/2013 |
| JP | 2013253379 | * | 12/2013 |
| JP | 2014-134377 | | 7/2014 |
| KR | 10-2011-0052324 | | 5/2011 |
| KR | 10-2011-0139977 | | 12/2011 |
| WO | WO 2011/149331 | | 12/2011 |

OTHER PUBLICATIONS

Korean Office Action dated Sep. 25, 2017 issued in Application No. 10-2016-0013063.

Japanese Office Action dated Feb. 27, 2018 issued in Application No. 2016-240020.

Chinese Office Action dated Jan. 2, 2019 issued in Application No. 201710043587.8 (English translation attached).

U.S. Office Action dated May 9, 2019 issued in parent U.S. Appl. No. 15/388,309.

* cited by examiner

APPARATUS FOR SENSING AND REMOVING DEW ON REFRIGERATOR AND CONTROLLING METHOD THEREOF

CROSS-REFERENCE TO RELATED APPLICATIONS

This application is a Divisional Application of U.S. patent application Ser. No. 15/388,309 filed Dec. 22, 2016, which claims priority under 35 U.S.C. § 119 to Korean Application No. 10-2016-0013063, filed on Feb. 2, 2016, whose entire disclosures are hereby incorporated by reference.

BACKGROUND

1. Field

This specification relates to an apparatus capable of sensing dew formation on a refrigerator and removing the dew, and a control method thereof.

2. Background

A refrigerator is an apparatus for storing food items therein in a cold or frozen state. Such a refrigerator is provided with a refrigerator body having therein a storage chamber, and a refrigeration cycle apparatus for cooling. Generally, a mechanical chamber is formed at a rear side of the refrigerator body, and a compressor and a condenser included in the refrigeration cycle apparatus are installed at the mechanical chamber.

The refrigerator may be classified according to an arrangement state of a refrigerating chamber and a freezing chamber. A top mount type refrigerator has a structure where a freezing chamber is disposed above a refrigerating chamber, and a bottom freezer type refrigerator has a structure where a refrigerating chamber is provided at an upper side and a freezing chamber is provided at a lower side. And a side by side type refrigerator has a structure where a freezing chamber and a refrigerating chamber are disposed right and left.

Since a temperature of the inside of the refrigerator is lower than a peripheral temperature of the refrigerator, dew may form at a circumference of a front surface of the body of the refrigerator, due to the temperature difference. Each of the top mount type refrigerator and the bottom freezer type refrigerator is provided with a pillar. Dew may also form on a front surface of the pillar, due to the temperature difference between the inside of the refrigerator and the periphery of the refrigerator. The pillar serves to block a gap between doors when refrigerating chamber doors or freezing chamber doors are closed, thereby preventing leakage of cold air. In a case where two refrigerating chamber doors are disposed to be rotated in different directions in order to open and close a refrigerating chamber, the pillar blocks a gap between the two refrigerating chamber doors to prevent leakage of cold air. That is, there is a problem that vapor in the air is condensed to cause dew formation on the front surface of the body of the refrigerator and the pillar.

In the conventional art, in order to sense such dew formation and remove the formed dew, a temperature sensor and a humidity sensor are installed near the doors, rather than at the region where dew formation occurs. The sensors are configured to indirectly determine whether dew formation has occurred or not, and to operate a heater to remove the formed dew. Alternatively, the sensors are configured to sense a change in resistance due to dew formed on the pillar, and thus to measure dew formation and dew amount.

However, in this case where the heater is controlled by determining dew formation based on temperature and humidity measured near the doors, rather than sensing dew directly in a region of the refrigerator where dew formation occurs, it is difficult to precisely measure dew formation. This may result in unnecessary operation of the heater. Further, in case of measuring resistance due to dew formation, the resistance may be measured erroneously due to foreign materials.

In order to precisely determine dew formation on a refrigerator, required is a method capable of preventing unnecessary power consumption by sensing dew formation only when dew is formed on a dew formation region and then by driving a heater, not by indirectly determining whether dew formation has occurred or not based on measured temperature or humidity. Further, required is an apparatus for sensing dew formation and removing the formed dew, by making the sensing unit not to be exposed to the outside, by sensing dew inside the front surface of the refrigerator body or inside the pillar. For example, the sensing unit may be provided such that it is not exposed to the outside, thereby preventing foreign materials from contacting a sensing unit.

BRIEF DESCRIPTION OF THE DRAWINGS

The embodiments will be described in detail with reference to the following drawings in which like reference numerals refer to like elements wherein.

DETAILED DESCRIPTION

Hereinafter, a refrigerator and a method for controlling the same according to the present disclosure will be explained in more detail with reference to the attached drawings.

For the sake of brief description with reference to the drawings, the same or equivalent components will be provided with the same reference numbers, and description thereof will not be repeated. A singular expression in the specification includes a plural meaning unless it is contextually definitely represented.

Figure 1:
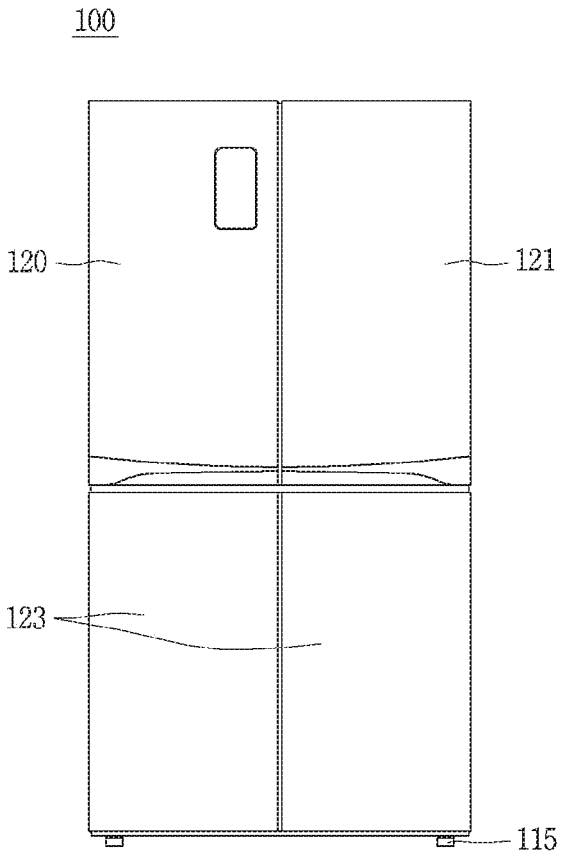
FIG. 1 is a frontal view of a refrigerator according to the present disclosure.

FIG. 1 is a frontal view of a refrigerator 100 according to the present disclosure. The refrigerator 100 is an apparatus for maintaining food items stored in a body 110 of the refrigerator 100 at a low temperature, using cold air generated by a refrigeration cycle composed of a compression process, a condensation process, an expansion process and an evaporation process.

FIG. 1 illustrates a bottom freezer type refrigerator 100 where a freezing chamber is disposed at a lower side and a refrigerating chamber is disposed at an upper side. However, the present disclosure is not limited to such a bottom type of refrigerator. That is, the present disclosure may be also applicable to a top mount type refrigerator where a freezing chamber is disposed above a refrigerating chamber.

Doors 120, 121, 123 are disposed on a front surface of the refrigerator 100, and the doors 120, 121, 123 form the front surface of the refrigerator 100. In case of the bottom freezer type of refrigerator 100, the refrigerating chamber doors 120, 121 are installed above the freezing chamber door 123, and the freezing chamber door 123 is installed below the refrigerating chamber doors 120, 121.

The refrigerating chamber doors 120, 121 and the freezing chamber doors 123 may be installed on the left and right sides of the body 110 of the refrigerator 100. The left door and the right door may rotate in opposite directions to open and close the inside of the refrigerator 100.

Height control screws 115 configured to control a height of the refrigerator 100 may be installed below the refrigerator 100. The height control screws 115 may be withdrawn from the body 110 of the refrigerator 100, or may be inserted into the body 110 of the refrigerator 100. The height control screws 115 serve to locate the refrigerator 100 in a horizontal state according to an installation place of the refrigerator 100.

In this specification, the refrigerator 100 is configured as a two-door type refrigerator. However, the apparatus for sensing and removing dew on the refrigerator according to the present disclosure may be also applied to a refrigerator having a plurality of doors, as well as a refrigerator having a single door.

Figure 2:
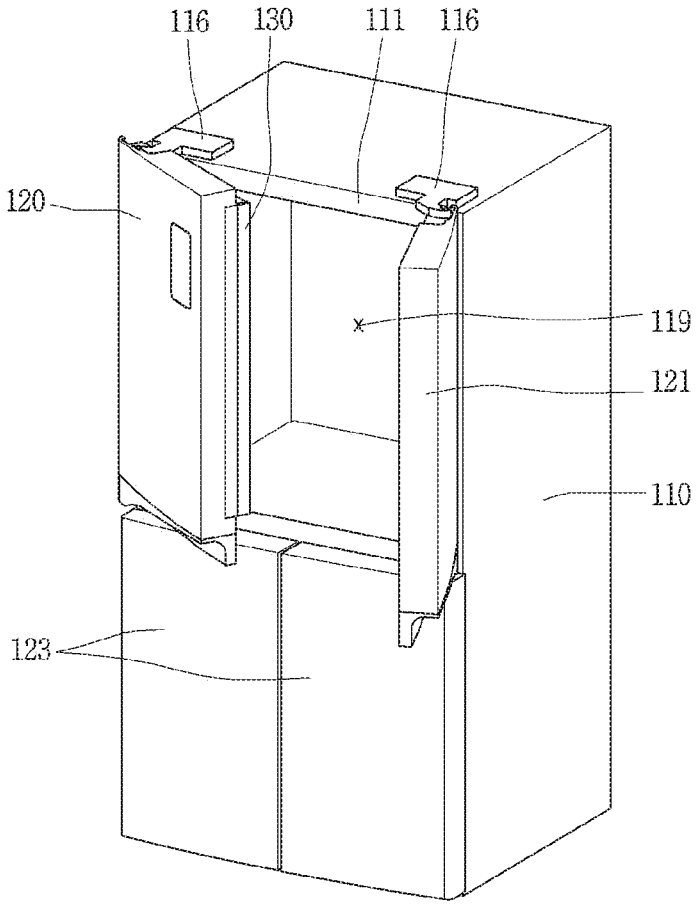
FIG. 2 is a perspective view of a refrigerator when a refrigerating chamber door is open.

FIG. 2 is a view illustrating the inside of the refrigerating chamber doors and the refrigerating chamber when the refrigerating chamber doors 120, 121 are open.

The refrigerating chamber doors 120, 121 may rotate to open and close an inner space where food items are stored. The refrigerating chamber doors 120, 121 are formed to open and close the refrigerating chamber, and the freezing chamber door 123 is formed to open and close the freezing chamber. The refrigerating chamber doors 120, 121, and the freezing chamber door 123 may be rotatably installed at the body 110 of the refrigerator 100. Rotation of each of the doors 120, 121, 123 may be implemented by a hinge 116. The refrigerator 100 may include a plurality of hinges 116 for implementation of rotation of each of the doors 120, 121, 123. The hinges 116 may be categorized into upper, lower and intermediate hinges according to installation positions thereof.

Figure 5:
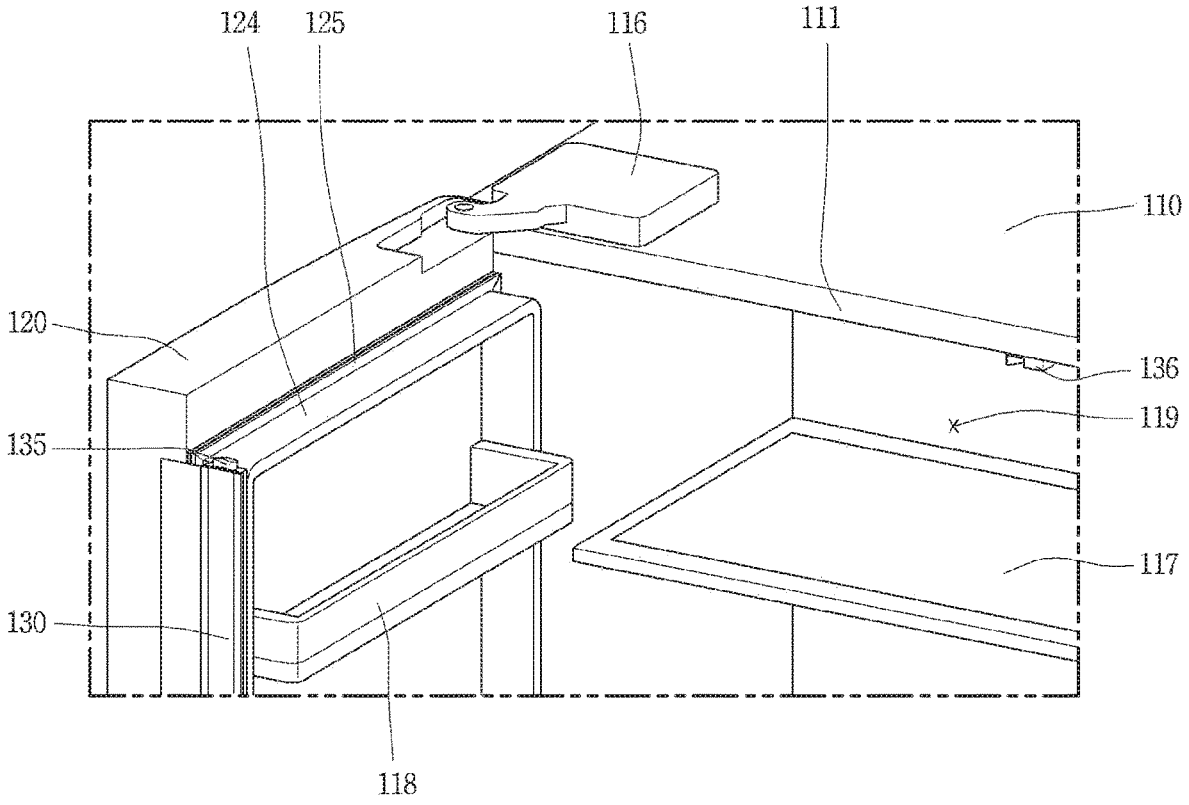
FIG. 5 is a view illustrating a front surface of a body and an inner space when a door is open.

As shown in FIG. 5, one or more accommodation units for efficiency spatial utilization may be provided at an inner space of the refrigerator 100. Part of the accommodation units may be formed at each of the doors 120, 121, 123. The accommodation units may include a shelf 117, a tray and a basket 118. The shelf 117 may be formed to locate food items at a storage space 119 of the refrigerator 100, and the tray may be formed to be slidable. Food items may be stored at a space exposed to the outside when the tray is pulled. The basket 118 may be installed in the doors 120, 121, 123. The upper hinges 116 may be installed on an upper surface of the body 110 of the refrigerator 100. The doors 120, 121, 123 may include an external plate (not shown), a door liner 124 and a gasket 125.

The doors 120, 121, 123 of the refrigerator 100 may be formed as a rotary type, a drawer type, etc. In the present disclosure, each of the doors 120, 121, 123 of the refrigerator 100 are disclosed as being a rotary type, since the pillar 130 is rotated by an opening and closing operation of the doors, but are not limited thereto. The body 110 has therein the storage space 119, and includes a first door 120 and a second door 121 installed on the right and left sides of the body 110. The first and second doors 120, 121 are rotated in different directions to open and close the storage space of the body 110. In the present disclosure, the first and second doors 120, 121 are differentiated from each other for convenience only, and mean doors disposed at a front side of the storage space and installed on the right and left sides of the body 110.

Figure 3:
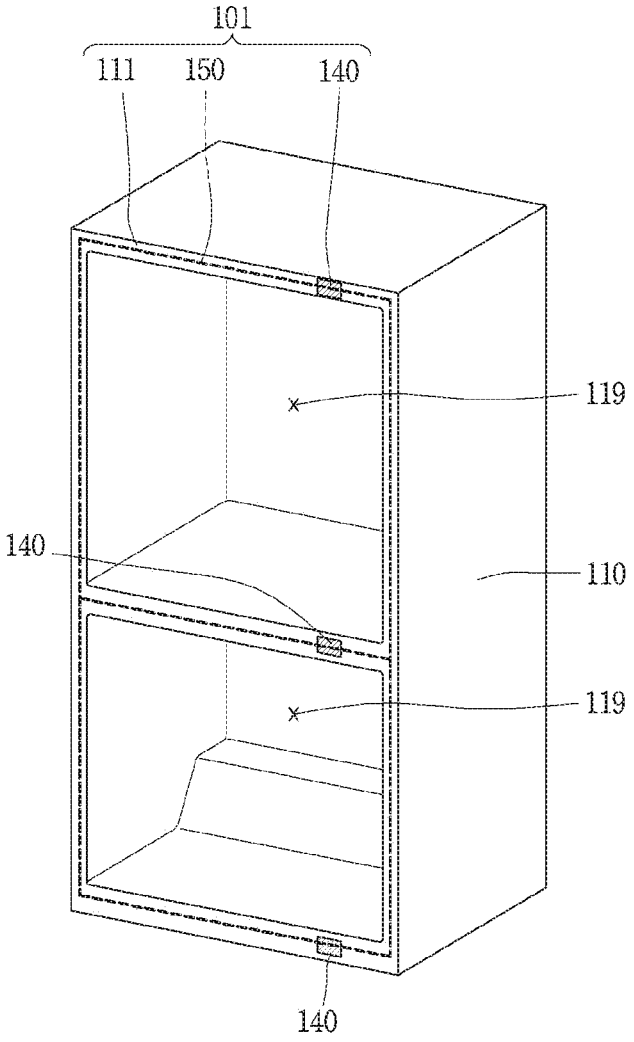
FIG. 3 is a frontal view illustrating a front surface of a body.

FIG. 3 illustrates a body front surface 111, and a sensing unit 140 and a heater 150 disposed in the body front surface 111. The body front surface 111 of the refrigerator 100 may be a front surface of a frame which forms the body 110, which is part where dew formation occurs due to a temperature difference between the storage space 119 of the refrigerator 100 and the periphery. That is, the body front surface 111 of the refrigerator 100 may mean a front surface of the frame of the body 110. The body front surface 111 of the refrigerator 100 having a space where the heater 150 and the sensing unit 140 are located, and a structure thereof will be explained later. The sensing unit 140 may be a sensor or a sensing device.

Since the storage space 119 of the refrigerator 100 is maintained at a low temperature for storage of food items, dew may form at the body front surface 111 of the refrigerator 100 which is located at a front side of the storage space 119 of the refrigerator 100, due to a temperature difference between the storage space 119 and the periphery.

If dew is formed on the body front surface 111 of the refrigerator 100, the formed dew may flow down along the body front surface 111. In this case, the dew may be collected on the floor where the refrigerator 100 is located, which may degrade appearance or cause damage.

The present disclosure is related to an apparatus 101 for sensing and removing dew formed on a refrigerator, which is capable of preventing dew formation on the refrigerator 100 by sensing dew formed on a front surface of the refrigerator 100 and driving the heater 150. For this, the apparatus 101 includes the heaters 150 disposed inside the body front surface 111 of the refrigerator 100 and inside the pillar 130, and the sensing units 140 disposed near the heaters 150 and configured to sense dew formation on the body 110 or the pillar 130 due to a temperature difference between the inside and the outside of the refrigerator in a non-contacting manner. The apparatus 101 for sensing and removing dew on a refrigerator is capable of preventing dew formation on the body front surface 111 or the pillar 130 of the refrigerator 100, by removing dew sensed by the sensing unit 140 by driving the heater 150.

Figure 4:
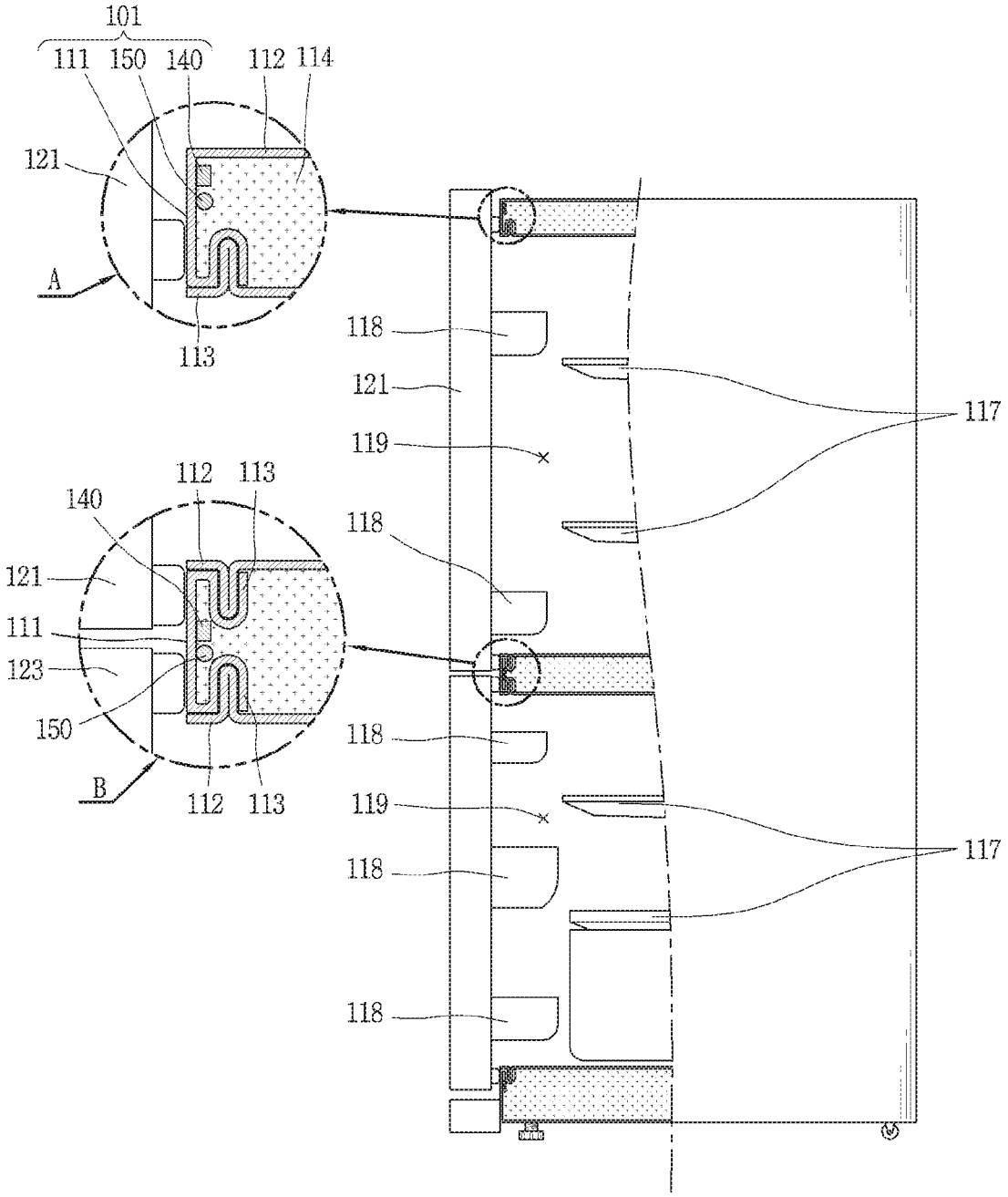
FIG. 4 is a side sectional view, which is viewed from one side of a refrigerator according to the present disclosure.

FIG. 4 is a side sectional view, which is viewed from one side of the refrigerator 100 according to the present disclosure. FIG. 4 illustrates a structure of each of the sensing unit 140, the heater 150 and the body front surface 111 by enlarging the body front surface 111, the sensing unit 140 and the heater 150 disposed in the body front surface 111. The body 110 has a structure where an outer case 112 and an inner case 113 are fixed in an engaged state with each other.

As shown in the enlarged part A of FIG. 4, the body front surface 111 has a structure where the outer case 112 having its upper part exposed to the outside, and the inner case 113 disposed below the outer case 112 and extending along the storage space 119 of the refrigerator 100, are engaged with each other to be supported. Each of the inner case 113 and the outer case 112 may be formed of a metallic material. An insulating member 114 may be disposed at an inner space formed by the engaged structure between the inner case 113 and the outer case 112. The insulating member 114 is configured to prevent dew formation due to a temperature difference between the inside and the outside of the refrigerator, and may be formed of urethane. The enlarged part B of FIG. 4 shows the apparatus 101 for sensing and removing dew that is provided on a partition that separates the freezing chamber and the refrigerating chamber. Here, the heater 150 and the sensing unit 140 may be provided on an inner surface of the inner case 113.

In the present disclosure, dew formation may be sensed by the sensing unit 140, and then the sensed dew is removed by the heater 150, the sensing unit 140 and the heater 150 being adjacent to each other on the front surface of the body 110. Since the sensing unit 140 and the heater 150 are adjacent to each other, if dew is sensed by the sensing unit, the sensed dew is removed as the heater 150 is driven to heat a dew formation region.

The sensing unit 140 may be configured to sense a dielectric constant that changes in response to dew formation, and may be disposed close to the heater 150. The sensing unit 140 may sense dew formed on the body 110 or the doors 120, 121, at a region separated from the dew formation region, in a non-contacting manner. As shown in FIG. 4, the sensing unit 140 may be installed on an inner surface of the outer case 112 formed of a metallic material. The sensing unit 140 may be positioned so as to be separated from the body front surface 111, and is configured to sense dew formation on the body front surface 111 even though it is positioned on the inner surface of the outer case 112. As shown in FIG. 4, the apparatus 101 for sensing and removing dew on a refrigerator may include the heater 150 and the sensing unit 140 disposed in the body front surface 111 along a circumference of the body front surface 111.

The heater 150 and the sensing unit 140 may be disposed in a partition wall separated from a dew formation region, and may be disposed inside the outer case 112 formed along a circumference of the body front surface 111. The heater 150 and the sensing unit 140 may be disposed in the pillar 130 to be explained later.

The heater 150 may be disposed on a rear surface of the outer case 112 so as to be extended along a circumference of the outer case 112, or may be disposed so as to be distant from the outer case 112 by a predetermined distance. The sensing unit 140 disposed near the heater 150 may be positioned in the outer case 112. The sensing unit 140 may be disposed at a plurality of positions of the outer case 112.

The sensing unit 140 may measure a dielectric constant that changes according to the amount of dew formed on a front surface of a metallic member, and may be configured to sense dew formation by measuring a change in a dielectric constant measured due to dew formed on a front surface of the outer case 112.

The sensing unit 140 may include a CMC sensor and a substrate. The CMC sensor may be configured to measure a change in dielectric constant due to dew formed on a front surface of the pillar 130, and may be provided with a carbon-micro-coil (CMC). The CMC is a coil based on a magnetic material having a similar structure to a Meissner corpuscle, and has a coiled shape such as a pig tail, not a straight shape. The CMC, amorphous carbon fiber, has an excellent elastic force. The CMC exhibits super-elasticity where its length is increased by ten times or more than the original length. The CMC may be utilized as an inductor, a core component of an electric circuit. Due to its electric and chemical characteristics, CMC may be used as an electromagnetic wave absorbent, a hydrogen absorbent, a microwave heating element, a tactile proximity sensor, or a biological activation agent. Especially, conventional carbon material shields electromagnetic waves in a low frequency domain, whereas the CMC absorbs at least 99% of electromagnetic waves in a high frequency domain more than several tens of GHz.

A measured dielectric constant may change according to the amount of dew formed on the front surface of the pillar 130, and a sensed dielectric constant may change as dew is formed on the front surface of the outer case 112 formed of a metallic material. The CMC undergoes a physical change in response to the change in dielectric constant, and thus an impedance value is changed. Here, the physical change means an increase or decrease of a gap between coils which constitute the CMC. The CMC sensor may sense not only dew contacting thereto, but also dew which exists within a predetermined distance in a non-contacting manner.

The CMC sensor may be positioned on a substrate having an electrode, the electrode contacting the CMC sensor and configured to measure a dielectric constant due to a magnetism change by a physical change of the CMC sensor and to transmit the dielectric constant to the outside. The substrate may be connected to a power unit, and may be supplied with power for operating the CMC sensor from the outside. That is, the sensing unit 140 may sense whether dew formation has occurred or not, based on a change in a dielectric constant due to dew formed on the front surface of the outer case 112.

The heater 150 may be disposed in the outer case 112, so as to be extended along a circumference of the front surface of the body 110. The heater 150 has a structure to emit heat when power is supplied thereto, and is formed of a material having a large resistance. Generally, the heater 150 may be formed of copper, but the present disclosure is not limited thereto. The sensing unit 140 may sense a change in dielectric constant due to dew formed on the body front surface 111 of the body 110, and the sensed dielectric constant may be transmitted to a controller. In this case, if the dielectric constant is more than a reference value, the controller determines that dew formation has occurred, and transmits a signal to drive the heater 150, to the heater 150. Since the heater 150 emits heat when power is supplied thereto, it may remove dew formed on the front surface of the outer case 112 through evaporation.

Once dew formed on the front surface of the outer case 112 is removed, the dielectric constant sensed by the sensing unit 140 may once again change. If the dielectric constant sensed by the sensing unit 140 becomes lower than a reference value, the controller may transmit a signal to the heater 150 to stop operation. It should be appreciated that the reference valve for turning on the heater may be the same or different than the reference valve for turning off the heater.

In the present disclosure, since the heater 150 is driven through the controller only when dew is sensed by the sensing unit 140, driving of the heater 150 may be minimized. Further, since an unnecessary increase of a temperature of the refrigerator 100 may be prevented as an unnecessary driving of the heater 150 is reduced. This may reduce power consumption of the refrigerator as performance of the refrigerator 100 (storing food at a low temperature) is enhanced.

FIG. 5 is an enlarged view illustrating a structure of the body front surface 111 of the refrigerator 100 when the door is open. The pillar 130 may be installed at one side of the refrigerating chamber door 120 or 121. Here, the one side of the door means a region of one door, which faces the other door when the right and left doors are closed. The doors include the first door 120 and the second door 121 distinguished from each other for convenience, and the pillar 130 may be installed at one side of the first door 120 or the second door 121.

In FIG. 5, all of the refrigerating chamber doors are open. If all of the refrigerating chamber doors are closed, the pillar 130 installed at the left refrigerating chamber door may face the right refrigerating chamber door. When all of the refrigerating chamber doors (the right and left refrigerating chamber doors) are closed, the pillar 130 is disposed between the right and left refrigerating chamber doors.

The doors are open and closed repeatedly as a user accesses food stored in the refrigerator 100. Accordingly, if the right and left refrigerating chamber doors are disposed in a contacting manner with each other, or if the right and left freezing chamber doors 123 are disposed in a contacting manner with each other, the doors may be damaged over time due to repeated use. In order to prevent such damage to the doors, the left door and the right door are spaced apart from each other. When the left door and the right door are closed, a gap is generated between the left door and the right door in a vertical direction. Referring to FIG. 2, a gap is shown between the two closed freezing chamber doors 123. Likewise, a gap may exist between the two refrigerating chamber doors 121, 122. The pillar 130 may be installed at one side of the refrigerating chamber door 121 or 122 to block this gap.

Figure 6:
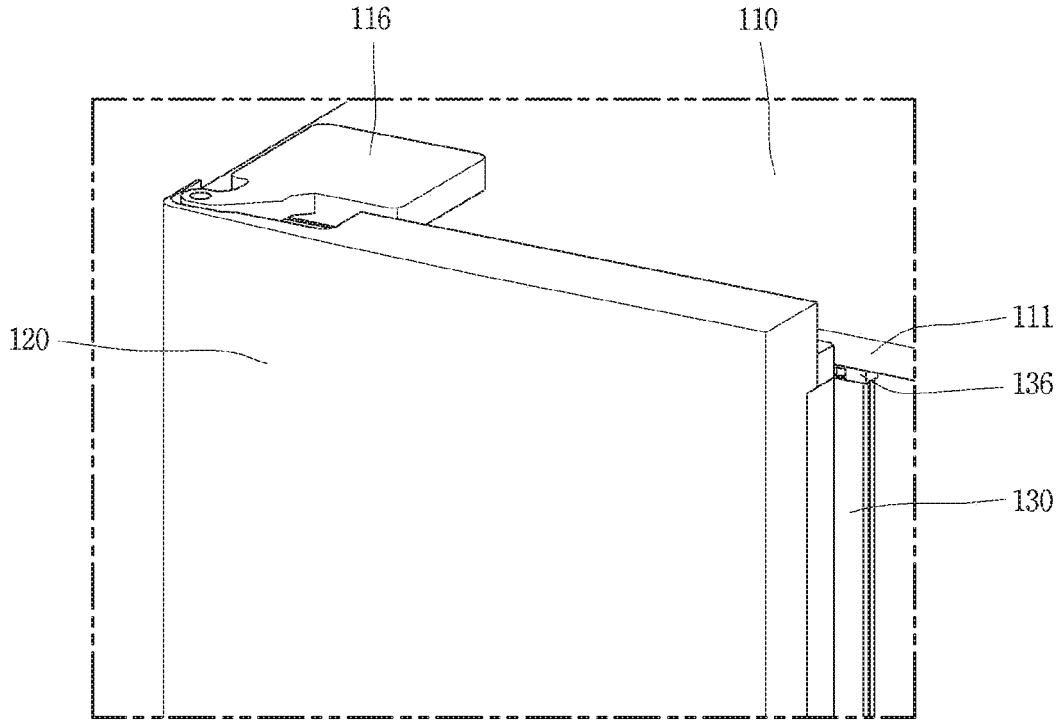
FIG. 6 is a partial perspective view illustrating a closed door state, and a pillar disposed between doors.

FIG. 6 illustrates a closed state of the doors of the refrigerator 100, and the pillar 130 disposed between the doors. As shown in FIGS. 5 and 6, the pillar 130 may be installed at one of the refrigerating chamber doors 120, 121. However, the pillar 130 may be installed at the body 110. In the latter case, the pillar 130 may be fixed to a front surface of the refrigerator 100, which divides the storage space 119 of the refrigerator 100 in a vertical direction. In this case, the structure to install the pillar 130 at the body 110 may interfere with a user's operation to put food items in the storage space 119 of the refrigerator 100 or take out the food items. As shown in FIGS. 5 and 6, if the pillar 130 is installed at one of the doors, when the doors are open, the pillar 130 is moved together with the doors in an attached state to the door as the doors are rotated. Accordingly, the pillar 130 does not block an inner space of the refrigerator 100, and does not interfere with the user when accessing the storage space. As shown in FIGS. 5 and 6, a protrusion 135 may be formed at an upper end of the pillar 130, and the protrusion 135 may be moved along a curved surface of an accommodation unit 136 installed at the body 110 of the refrigerator 100. This may allow an opening/closing operation by rotation of the door.

When the doors of the refrigerator 100 are closed, the pillar 130 may be positioned between the doors of the refrigerator 100, at a front side of the storage space 119 of the refrigerator 100. Dew may form on a front surface of the pillar 130 due to a temperature difference between the storage space 119 of the refrigerator 100 and the periphery.

Figure 7:
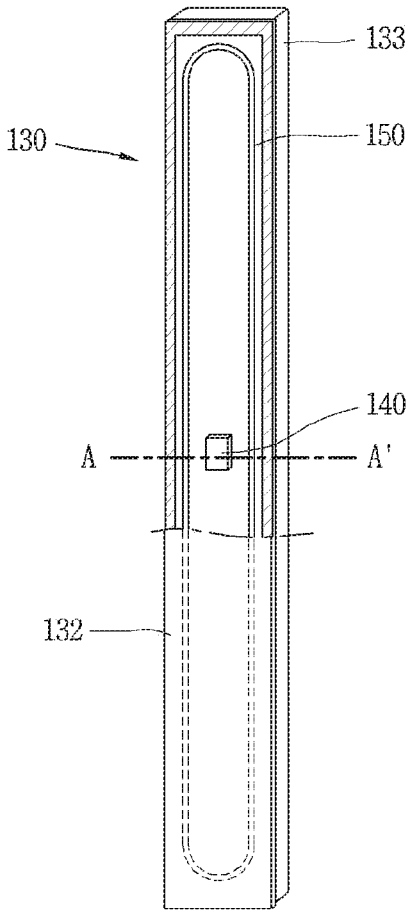
FIG. 7 is a frontal view illustrating a shape of the pillar.

FIG. 7 is a view illustrating the pillar 130. The pillar 130 may serve to prevent leakage of cold air by blocking a gap between the doors of the refrigerator 100, and may be rotatably installed at one side of each door of the refrigerator 100. The pillar 130 may be formed to extend in upper and lower directions so as to block a gap between the first and second doors 120, 121 when the body 110 is adhered to the first and second doors 120, 121.

The pillar 130 may include a first member 132, a second member 133, the sensing unit 140 and the heater 150. The first member 132 may extend in a plate shape in upper and lower directions, and may be coupled to the second member 133. The first member 132 forms a front surface of the pillar 130, and may be formed of a metallic material such that a dielectric constant sensed by the sensing unit 140 due to dew formation is changed. This is in order for the sensing unit 140 to measure a dielectric constant changed on a rear surface 132*a* (see FIG. 8) of the first member 132, due to dew formed on the front surface of the first member 132. Once dew is formed on the front surface of the pillar 130 (the front surface of the first member 132), a dielectric constant sensed by the sensing unit 140 due to the formed dew is changed.

The first and second members 132, 133 may be coupled to each other to form an inner space 137. More specifically, the second member 133 may be fixed to a rear surface 132*a* of the first member 132 by using a screw, an adhesive, or another appropriate means. The sensing unit 140 measures a change of a dielectric constant due to dew formed on the front surface of the pillar 130. When the amount of dew is increased, a dielectric constant is increased.

In order to sense dew formed on the front surface of the first member 132 (e.g., the front surface of the pillar 130), rather than formed on the second member 133, the second member 133 may be formed of plastic, synthetic resin, etc., whereas the first member 132 may be formed of a metallic material.

The sensing unit 140 may be installed in the pillar 130. More specifically, the sensing unit 140 may be positioned at an inner space 137 formed as the first and second members 132, 133 are coupled to each other, or at one side of the rear surface 132*a* of the first member 132. However, the sensing unit 140 should be positioned not to be exposed to the outside. And the sensing unit 140 may be installed in the pillar 130, or a plurality of sensing units 140 may be installed at a plurality of positions on the rear surface 132*a* of the first member 132. In this case, each of the sensing units 140 may sense a change in dielectric constant due to dew formed on different regions on the front surface of the first member 132, thereby enhancing accuracy and sensitivity in sensing dew formation.

The sensing unit 140 may be composed of a CMC sensor and a substrate. As aforementioned, the sensing unit 140 may be provided with a carbon-micro-coil (CMC) sensor, and may be positioned in the pillar 130 or on the rear surface 132*a* of the first member 132. Hence, the sensing unit 140 may sense dew formed on the front surface of the first member 132 in a non-contacting manner. A structure of the CMC sensor, and the CMC will be replaced by the aforementioned explanations.

A dielectric constant sensed by the sensing unit 140 may change due to dew formed on the front surface of the pillar 130. Since the CMC sensor undergoes a physical change in response to a change of a dielectric constant, an impedance value may change. The CMC sensor may sense not only dew contacting thereto, but also dew disposed within a preset distance in a non-contacting manner.

The heater 150 may be installed on the rear surface 132*a* of the first member 132 or at the inner space 137 formed by the first and second members 132, 133. In a case where the dielectric constant measured by the sensing unit 140 is more than a preset value, the heater 150 may be controlled to emit heat such that dew formed on the front surface of the pillar 130 is evaporated. The heater 150 may be driven by receiving a signal after a determination by the controller. Explanations about the heater 150 will be replaced by the aforementioned ones.

An insulating member may be disposed at a space between the first and second members 132, 133, such that heat transfer between the first and second members 132, 133 may be interrupted. The insulating member may be formed of styrofoam having a high insulating property. However, it may be difficult to fill a large amount of insulating material in the pillar 130. The reason for this is due to an operation structure of the pillar 130 which is rotated by an opening and closing operation of the doors, and a limited size of the pillar 130. Due to the operation structure and the limited size of the pillar 130, a temperature of the surface of the pillar 130 may be lower than a dew point, and dew may form on the surface of the pillar 130. In order to prevent such dew formation on the pillar 130, the heater 150 installed in the pillar 130 may be configured to evaporate dew by heat emitted therefrom.

The present disclosure may further include the controller configured to transmit an electric signal to the heater 150 so as to drive the heater 150 when a dielectric constant measured by the sensing unit 140 is more than a preset value. The controller may determine whether a dielectric constant measured by the sensing unit 140 is more than a preset value. Then, if the dielectric constant is more than the preset value, the controller may transmit a signal to the heater for operating the heater 150.

In order to prevent dew formation on the surface of the pillar 130, the heater 150 installed in the pillar 130 may be heated to increase a temperature of the pillar 130, and thereby remove dew formed on the pillar 130. However, if the heater 150 is driven, additional power is consumed, and heat generated as the heater 150 is driven may be introduced into the refrigerator 100. This is against the original purpose of the refrigerator 100 (storing food at a low temperature), and may increase power consumption. In order to prevent dew formation through use of the heater 150, a time point to drive the heater 150 may be precisely determined. The sensing unit 140 disposed close to the heater 150 may directly sense dew formation, and transmit a signal to the controller such that a time point to drive the heater 150 due to dew formation is more precisely determined.

Figure 8:
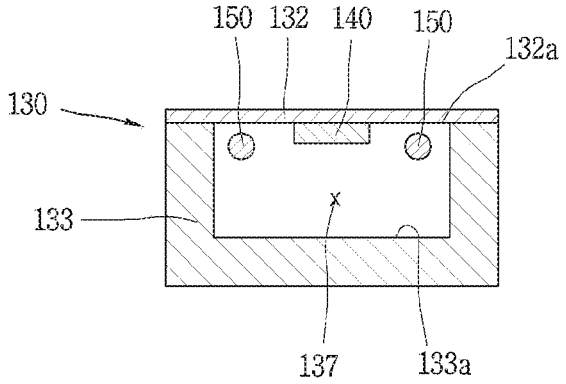
FIG. 8 is a sectional view of the pillar, which is taken along line A-A' in FIG. 6.

FIG. 8 is a sectional view of the pillar 130, which is taken along line A-A' in FIG. 7. As aforementioned, the pillar 130 may include the first member 132, the second member 133, the sensing unit 140 and the heater 150.

The sensing unit 140 may be positioned on the rear surface 132*a* of the first member 132. The rear surface 132*a* of the first member 132 means one surface of the first member 132 disposed to face the second member 133, which means an opposite surface to an upper surface of the first member 132. The sensing unit 140 may sense dew formed on the front surface of the first member 132. Once dew formation is sensed by the sensing unit 140, the heater 150 disposed between the first and second members 132, 133 is driven to evaporate the dew formed on the front surface of the first member 132. Once the dew formed on the front surface of the first member 132 is removed, a dielectric constant measured by the sensing unit 140 returns to the original value.

Figure 9:
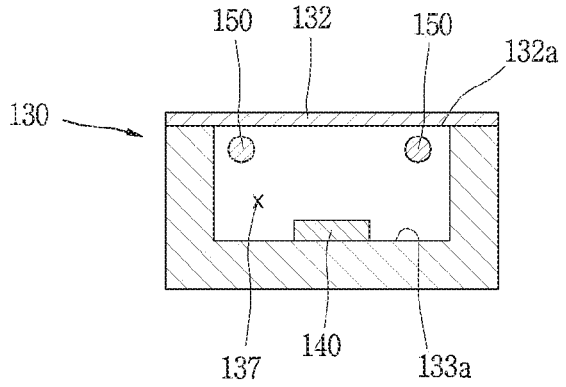
FIG. 9 is a view illustrating another embodiment of the pillar shown in FIG. 8.

FIG. 9 is a view illustrating another embodiment of the pillar 130 shown in FIG. 8. Unlike the pillar 130 of FIG. 8, the sensing unit 140 of FIG. 9 is positioned in a space between the first and second members 132, 133, and may be installed on a front surface 133*a* of the second member 133. The second member 133 may be formed of an insulating material such as plastic. The sensing unit 140 may be configured to sense dew formed on the front surface of the first member 132, and is positioned to face the front surface of the first member 132 even if dew is formed at the inner space 137 formed between the first and second members 132, 133. And dew formation may be prevented by an insulating member disposed at the inner space 137. Accordingly, the sensing unit 140 may measure changes in the dielectric constant due to dew formed on the front surface of the first member 132. A structure of the sensing unit 140 is the same as the aforementioned one.

Figure 10:
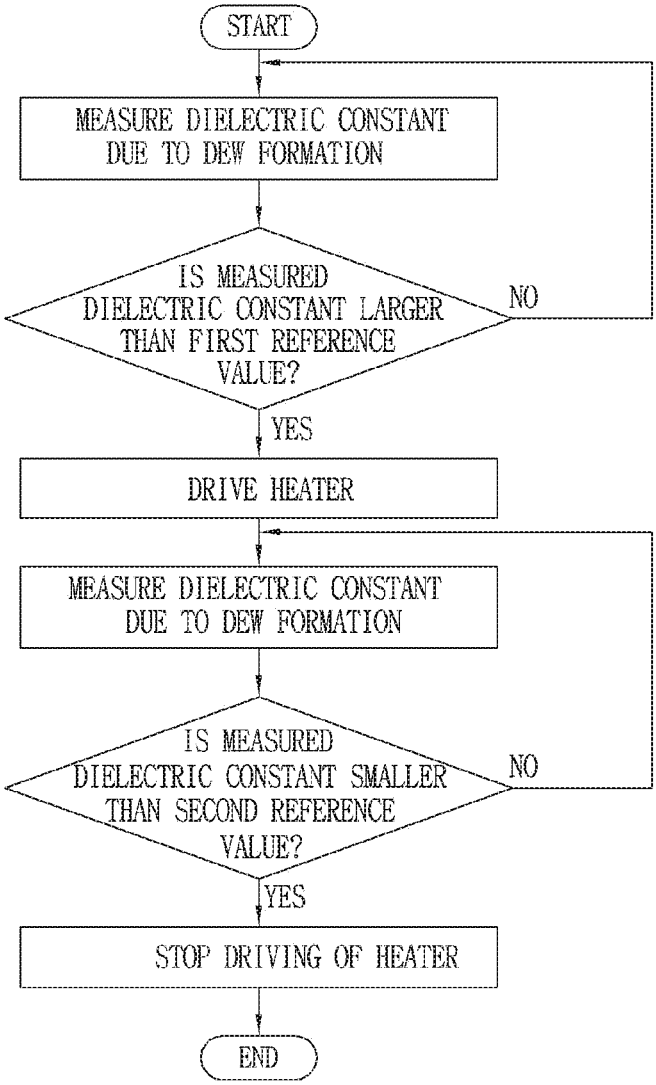
FIG. 10 is a flowchart illustrating a method for controlling an apparatus for sensing and removing dew formed on a refrigerator.

So far, the apparatus for sensing dew formation and removing the formed dew has been explained, and a method for controlling the apparatus will be explained. FIG. 10 is a flowchart illustrating a method for controlling the apparatus for sensing and removing dew formed on a refrigerator. The method for controlling the apparatus for sensing and removing dew formed on a refrigerator includes first to fourth steps.

The first step is a process of measuring, by the sensing unit 140, a dielectric constant changed due to dew formed on the body front surface 111 of the body 110 of the refrigerator 100, or dew formed on the pillar 130. As aforementioned, since the sensing unit 140 may include the CMC sensor, it serves to measure a dielectric constant according to the amount of dew formed on the body front surface 111 and the pillar 130, in the body front surface 111 and the pillar 130.

The second step is a process of comparing the dielectric constant measured in the first step with a first reference value, and then operating the heater 150 disposed in the pillar when the measured dielectric constant is greater than the first reference value. The heater 150 emits heat by receiving power, and removes dew formed on the body front surface 111 and on the front surface of the pillar 130 through evaporation. A signal for operating the heater 150 may be transmitted to the heater 150 through the controller. The controller may compare the dielectric constant measured in the first step with the first reference value, and then transmits a signal to the heater 150 to supply power to the heater 150 when the measured dielectric constant is greater than the first reference value. The first reference value may be determined as a dielectric constant corresponding to a known amount of dew condensed, which may be determined experimentally. For instance, in a case where a predetermined amount of dew is condensed, if a user wishes to sense the condensed dew and drive the heater, the first reference value may be determined with considering that a dielectric constant of water is 80. Further, the heater may be heated to a predetermined temperature by receiving a predetermined amount of power.

The third step is a process of measuring a dielectric constant while operating the heater 150 according to the second step. If the heater 150 is operated according to the second step, the dew formed on the front surface of the pillar 130 or formed on the body front surface 111 is removed through evaporation since its temperature is increased. This may cause a dielectric constant to be changed.

The fourth step is a process of comparing the dielectric constant measured in the third step with a second reference value, and then stopping the heater 150 when the measured dielectric constant is less than the second reference value. If the dielectric constant measured by the sensing unit 140 is less than the second reference value, the controller transmits, to the heater 150, a signal to stop supply of power to the heater 150. Likewise, the second reference value means a reference value of a dielectric constant measured by the sensing unit as the formed dew is removed by a driving of the heater, which means a dielectric constant different from the first reference value. The second reference value may be determined experimentally, and may be preferably formed as a value less than the first reference value. That is, if a dielectric value sensed by the sensing unit is greater than the first reference value, the heater is operated. On the other hand, if the dielectric value sensed by the sensing unit while the heater is being operated is smaller than the second reference value, the heater is stopped. With such a control method, dew formation may be sensed, and the formed dew may be removed.

As broadly described and embodied herein, an aspect of the detailed description is to provide an apparatus capable of preventing dew formation on a front surface of a refrigerator.

Another aspect of the detailed description is to provide an apparatus capable of directly sensing dew formed on a refrigerator, and removing the sensed dew by driving a heater disposed near the refrigerator.

Another aspect of the detailed description is to provide an apparatus capable of minimizing an operation of a heater through an enhanced accuracy of sensing, by controlling a sensing unit to sense dew only when dew formation occurs.

Another aspect of the detailed description is to provide an apparatus capable of sensing dew formed on a front surface of a refrigerator body or a pillar, and then removing the formed dew, even when a sensing unit for sensing dew is not exposed to the outside.

To achieve these and other advantages and in accordance with the purpose of this specification, as embodied and broadly described herein, there is provided an apparatus for sensing and removing dew on a refrigerator, including: a heater disposed at a refrigerator body or inside a metallic surface of a door; and a sensing unit disposed close to the heater, and configured to sense dew formed at the refrigerator body and the door in a non-contacting manner, at a region separated from the dew formation region, wherein the dew sensed by the sensing unit is removed as the heater is driven.

In one embodiment, the sensing unit may sense dew and a dew amount based on a dielectric constant changed only when dew is formed on the body or the door.

In one embodiment, the heater and the sensing unit may be disposed inside a partition wall spaced apart from the dew formation region.

In one embodiment, the sensing unit may be disposed inside a front surface of the refrigerator body, or inside a front surface of a pillar attached to the door.

In one embodiment, the sensing unit may include: a CMC sensor having a carbon-micro-coil (CMC), and physically changed by reacting with dew formed within a preset distance; and a substrate disposed below the CMC sensor, and having an electrode configured to transmit a dielectric value measured according to the physical change of the CMC sensor.

In one embodiment, the sensing unit may be installed inside the front surface of the pillar, so as to be separated from the front surface of the pillar.

In one embodiment, each of the front surface of the refrigerator body and the front surface of the pillar may be formed of a metallic material.

In one embodiment, the sensing unit may be installed on an inner surface of an outer case which forms the refrigerator body, so as to be separated from the front surface of the refrigerator body.

In one embodiment, the pillar may include: a first member extending in upper and lower directions in a plate shape; and a second member coupled to the first member to form an inner space. And the sensing unit may be installed on a plurality of regions on a rear surface of the first member.

In one embodiment, the apparatus may further include a controller configured to transmit an electric signal to operate the heater to the heater when the dielectric constant sensed by the sensing unit is more than a preset value.

To achieve these and other advantages and in accordance with the purpose of this specification, as embodied and broadly described herein, there is also provided a method of sensing and removing dew formed on a refrigerator, the method including: a first step of measuring, by a sensing unit, a dielectric constant changed due to dew formed on a front surface of a refrigerator body or a pillar; a second step of comparing the dielectric constant measured in the first step with a first reference value, and of operating a heater when the measured dielectric constant is larger than the first reference value; a third step of measuring a dielectric constant by the sensing unit while operating the heater of the second step; and a fourth step of comparing the dielectric constant measured in the third step with a second reference value, and of stopping the heater when the measured dielectric constant is smaller than the second reference value.

The apparatus and method of the present disclosure may have the following advantages. Firstly, dew formation may be prevented by sensing dew formed on a front surface of the refrigerator, and then by driving the heater. Secondly, dew formed on a front surface of the refrigerator and a front surface of the pillar may be sensed by the sensing unit having the CMC, based on a change in a dielectric constant. Thirdly, dew formed on a front surface of the refrigerator or the pillar is not indirectly sensed by a humidity sensor or a temperature sensor, but may be directly sensed by the sensing unit. This may enhance accuracy in sensing dew formation, resulting in minimized and more efficient operation of the heater for removing the formed dew. Fourthly, dew formation may be sensed by the sensing unit disposed inside the front surface of the refrigerator and inside the pillar.

Any reference in this specification to "one embodiment," "an embodiment," "example embodiment," etc., means that a particular feature, structure, or characteristic described in connection with the embodiment is included in at least one embodiment. The appearances of such phrases in various places in the specification are not necessarily all referring to the same embodiment. Further, when a particular feature, structure, or characteristic is described in connection with any embodiment, it is submitted that it is within the purview of one skilled in the art to effect such feature, structure, or characteristic in connection with other ones of the embodiments.

Although embodiments have been described with reference to a number of illustrative embodiments thereof, it should be understood that numerous other modifications and embodiments can be devised by those skilled in the art that will fall within the spirit and scope of the principles of this disclosure. More particularly, various variations and modifications are possible in the component parts and/or arrangements of the subject combination arrangement within the scope of the disclosure, the drawings and the appended claims. In addition to variations and modifications in the component parts and/or arrangements, alternative uses will also be apparent to those skilled in the art.

What is claimed is:

1. A method of sensing and removing dew formed on a refrigerator, the method comprising:

measuring, by a sensor, a first value of a dielectric constant that changes due to dew being formed on a front surface of a refrigerator body or a front surface of a pillar;

comparing, by a controller, the first measured value of the dielectric constant with a first reference value, and controlling a heater to operate when the first measured value of the dielectric constant is greater than the first reference value;

measuring, by the sensor, a second value of the dielectric constant while the heater is in operation to generate heat; and comparing, by the controller, the second measured value of the dielectric constant while the heater is in operation with a second reference value, and controlling the heater to stop operation when the second measured value of the dielectric constant is less than the second reference value, wherein the sensor is disposed on an inner surface of the refrigerator body or an inner surface of the pillar.

2. The method of claim 1, wherein the heater is disposed at the refrigerator body, and the sensor is disposed in proximity to the heater, and wherein the measuring, by the sensor, the first value of the dielectric constant includes sensing dew formed on a surface that is physically separate from the sensor.

3. The method of claim 1, wherein the front surface of the refrigerator body or the pillar is an outer surface on which dew is formed.

4. The method of claim 1, wherein each of the front surface of the refrigerator body and the pillar are formed of a metallic material.

5. The method of claim 2, wherein the pillar includes:

a first member having a plate shape that extends vertically, and a second member coupled to the first member to form an inner space, wherein the sensor includes a plurality of sensors separately installed at plurality of regions on a rear surface of the first member inside the inner space.

6. The method of claim 1, wherein the sensor includes:

a carbon-micro-coil (CMC) sensor having a carbon micro coil that undergoes a physical change in response to a reaction with dew formed within a predetermined distance; and a substrate having an electrode, the CMC sensor positioned on the substrate, and the electrode configured to transmit a dielectric value measured according to the physical change of the CMC sensor.

7. The method of claim 1, wherein the sensor is installed inside an outer case which forms the refrigerator body, so as to be separated from the front surface of the refrigerator body.

8. The method of claim 1, wherein the heater is disposed inside a surface of the pillar, and the sensor is disposed in proximity to the heater, and wherein the measuring, by the sensor, the first value of the dielectric constant includes sensing dew formed on a surface that is physically separate from the sensor.

9. An apparatus for sensing and removing dew on a refrigerator having a refrigerator body with a storage chamber, comprising:

a heater disposed in an inner space of the refrigerator body, the inner space formed by an outer case and an inner case;

a sensing unit disposed in the inner space of the refrigerator body, wherein the sensing unit is configured to sense formation of dew on a surface of the refrigerator body, and the heater is configured to provide heat to remove the sensed dew on the surface based on a signal from the sensing unit.

10. The apparatus of claim 9, wherein the outer case forms a body front surface of the inner space and extends from the body front surface and is exposed to outside of the refrigerator body, and the inner case extends from the body front surface along part of the chamber, wherein the inner space is formed between the outer case and the inner case.

11. The apparatus of claim 10, comprising an insulating member disposed within part of the inner space.

12. The apparatus of claim 11, wherein the insulating member is disposed between the sensing unit and the heater.

13. The apparatus of claim 11, wherein the sensing unit and the heater are separated by the insulating member.

14. The apparatus of claim 10, wherein the sensing unit is disposed on an inner surface of the outer case.

15. The apparatus of claim 10, wherein the sensing unit and the heater are spaced apart from each other in the inner space.

16. The apparatus of claim 10, wherein the sensing unit and the heater are disposed close to the body front surface.

17. The apparatus of claim 10, wherein the sensing unit is configured to sense dew on the body front surface.

18. The apparatus of claim 10, wherein the sensing unit includes a plurality of sensing units at a plurality of separate positions along an inner surface of the outer case.

* * * * *